US011232775B2

(12) United States Patent
Corder

(10) Patent No.: US 11,232,775 B2
(45) Date of Patent: Jan. 25, 2022

(54) HANDHELD NOISEMAKER

(71) Applicant: Charles J. Corder, Wadsworth, IL (US)

(72) Inventor: Charles J. Corder, Wadsworth, IL (US)

( * ) Notice: Subject to any disclaimer, the term of this patent is extended or adjusted under 35 U.S.C. 154(b) by 0 days.

(21) Appl. No.: 16/266,061

(22) Filed: Feb. 2, 2019

(65) Prior Publication Data

US 2020/0251081 A1 Aug. 6, 2020

(51) Int. Cl.
*G10K 3/00* (2006.01)

(52) U.S. Cl.
CPC ..... *G10K 3/00* (2013.01)

(58) Field of Classification Search
CPC ..... A63H 33/046
USPC ..... 446/92, 419, 421
See application file for complete search history.

(56) References Cited

U.S. PATENT DOCUMENTS 1,668,143 A * 5/1928 Daasch ..... A63H 5/00 473/571
2,301,506 A * 11/1942 Bean ..... A63H 33/00 273/145 C
2,492,922 A * 12/1949 McLain ..... A63H 33/00 434/403
2,570,625 A * 10/1951 Zimmerman ..... A63H 33/046 446/92
2,747,297 A * 5/1956 Zalkind ..... A63F 9/06 434/259
3,633,587 A * 1/1972 Hunt ..... A63H 5/00 606/235
3,995,855 A * 12/1976 Schultz ..... A63B 43/04 473/594
4,154,018 A * 5/1979 Churchman ..... A63H 5/00 273/109
4,261,572 A * 4/1981 Breinholt ..... A63F 9/181 273/145 C
4,300,767 A * 11/1981 Reed ..... A63B 39/00 473/594
4,480,828 A * 11/1984 Kifferstein ..... A63B 23/04 446/419
5,131,665 A * 7/1992 Myers ..... A63B 43/002 473/569
5,183,430 A * 2/1993 Swann ..... A63H 33/04 446/104
5,314,338 A * 5/1994 Caveza ..... G09B 19/00 434/259
5,372,450 A * 12/1994 Blodgett ..... A63H 33/10 403/171
5,738,560 A * 4/1998 Bears ..... A63H 5/00 446/220

(Continued)

*Primary Examiner* — Joseph B Baldori
(74) *Attorney, Agent, or Firm* — Alison M. Corder

(57) ABSTRACT

A noisemaker that produces sound when played. The noisemaker includes a body component comprising side portions assembled together to form a three-dimensional configuration with an interior space. One or more side portions include one or more aperture elements that open to the interior space. Within the interior space reside one or more core components that are each configured to move freely within the body component while not escaping through the aperture element. The aperture element and the core component are cooperatively designed to maintain the core component within the body component while the noisemaker is played by being struck, scraped, or rubbed.

19 Claims, 7 Drawing Sheets

(56) References Cited

U.S. PATENT DOCUMENTS 6,176,757 B1 * 1/2001 Lin ..... A63H 33/101
446/102
6,186,855 B1 * 2/2001 Bauer ..... A63H 33/04
446/104
6,565,406 B2 * 5/2003 Huang ..... A63H 33/042
446/104
6,969,294 B2 * 11/2005 Vicentelli ..... A63F 9/34
446/129
7,296,796 B2 * 11/2007 Mackenzie ..... A63F 9/04
273/145 C
D608,840 S * 1/2010 Crutchfield ..... D21/373
D638,070 S * 5/2011 Tyler ..... D21/372
8,052,552 B2 * 11/2011 Silverglate ..... A63H 5/00
446/419
8,458,863 B2 * 6/2013 Hunts ..... H01F 7/0242
24/303
8,695,979 B1 * 4/2014 Seldin ..... A63F 9/0001
273/153 R
D717,883 S * 11/2014 Chase ..... D21/455
9,022,829 B2 * 5/2015 Rosen ..... A63H 33/046
446/108
9,101,535 B2 * 8/2015 Silverglate ..... A63H 33/006
9,289,657 B1 * 3/2016 Rice ..... A63B 43/04
9,669,324 B2 * 6/2017 Roth ..... A63H 33/062
10,080,977 B2 * 9/2018 Rosen ..... A63H 33/101
10,328,355 B2 * 6/2019 Rosen ..... A63H 33/107
2002/0098774 A1 * 7/2002 Huang ..... G09B 19/02
446/487
2013/0165012 A1 * 6/2013 Klauber ..... A63H 33/10
446/91
2014/0179194 A1 * 6/2014 Fein ..... A63H 33/046
446/92
2016/0074766 A1 * 3/2016 Choi ..... A63H 33/046
446/92

* cited by examiner

HANDHELD NOISEMAKER

FIELD OF THE INVENTION

The invention relates generally to noisemakers. More particularly, the invention relates to handheld noisemakers for musical or entertainment purposes.

BACKGROUND OF THE INVENTION

A noisemaker is anything that makes noise. Certain noisemakers, known as "instruments", are used for musical purposes. One known instrument is the maraca. Certain other noisemakers, such as "rattles", are used for entertainment purposes by infants and toddlers, as well as animals.

Music pieces may be performed with any number of instruments. Instruments typically include string instruments (violin, cello, harp), woodwind instruments (flute, clarinet, saxophone), brass instruments (trumpet, horn, tuba), and percussion instruments (drum, cymbals, maraca).

Each musical instrument offers new and unique notes or sounds when played. And there is always a need, such as by musicians, for instruments that produce desired notes or sounds to create or perform musical works. Furthermore, very few musical instruments, if any, include interchangeable components in order to offer a variety of different notes or sounds to choose from. In addition, there is always a need for new and unique rattles to entertain infants, toddlers, or animals. The invention satisfies these needs.

SUMMARY OF THE INVENTION

The noisemaker according to the invention may be considered a percussion instrument, configured to produce notes or sounds by being played, e.g., struck, scraped, or rubbed by hand.

The noisemaker includes a body component comprising a hollow three-dimensional configuration. For example, the body component may be a polyhedron including a tetrahedron, a cube, an octahedron, a dodecahedron, an icosahedron. Other three-dimensional configurations may include a pyramid, a cylinder, a cone, a prism.

The body component comprises side portions assembled together to form the three-dimensional configuration with an interior space.

Each side portion is defined by two opposing faces surrounded by a perimeter edge. The perimeter edge of each side portion is assembled—permanently or impermanently—to other perimeter edges of other side portions to form the three-dimensional configuration. Each side portion may be any contemplated geometric form, for example, a square, a triangle, a rectangle, a pentagon, a hexagon, an octagon, a parallelogram, etc. Generally, it is contemplated that the side portion is planar, but a non-planar side portion is also contemplated such as a hollow hemisphere.

One or more side portions include one or more aperture elements. The aperture element may be any contemplated shape, for example, a square, a triangle, a rectangle, a pentagon, a hexagon, an octagon, a parallelogram, etc. The aperture element opens to the interior space of the body component.

One or more core components reside within the interior space of the body component. The core component is configured to move freely within the body component while not escaping through the aperture element. Each core component comprises a solid or hollow three-dimensional structure. The core component may be a polyhedron including a tetrahedron, a cube, an octahedron, a dodecahedron, an icosahedron. Other three-dimensional structures may include a pyramid, a cylinder, a cone, a prism, a sphere, etc.

The body component and the core component may be constructed from any material combination to produce notes or sounds in any musical range: soprano, alto, tenor, baritone, bass. Examples of materials from which the noisemaker may be constructed include, but is not limited to: wood, metal, alloy, canvas, plastic, glass, felts, rubber, animal skin.

The body component and the core component may be both made from the same material. Or they each may be constructed from different materials. For example, the body component may be made from wood and the core component made from solid metal. Similarly, in embodiments where the noisemaker includes a plurality of core components in the interior space, they each may be constructed from the same or different materials. For example, all core components made from solid wood or one core component made from solid wood and another core component made from hollowed-out metal.

It is also contemplated that the body component may be constructed of the same or different materials. For example, one side portion constructed from wood while another side portion is constructed from plastic.

In certain embodiments, the noisemaker may permit components to be interchangeable to offer a variety of notes or sounds to choose from. The body component may be constructed so that one or more side portions are fully or partially detachable from another side portion. This may be desirable to access the core component, for example, to remove or exchange a core component within the interior space. Or to swap out a side portion for another side portion made of a different material.

The aperture element and the core component are cooperatively designed to maintain the core component within the body component while the noisemaker is played. The noisemaker is played by being struck, scraped, or rubbed while holding it directly via the body component. It is also contemplated that the noisemaker may be played by moving it indirectly through a handle component.

New and unique notes or sounds are produced by the noisemaker. The notes and sounds are differentiated by characteristics—pitch, duration, loudness, timbre—dependent upon a combination of: (1) size of the body component including size of the interior space, (2) shape of the body component including shape of the interior space, (3) material of the body component, (4) size of each aperture element, (5) shape of each aperture element, (6) number of aperture elements, (7) size of each core component, (8) shape of each core component, (9) material of each core component, and (10) number of core components. The noisemaker can produce a vast variety of notes or sounds. The note or sound produced is dependent on the combination of characteristics selected for each (1) through (10).

The invention may be further understood in light of the detailed description below describing one contemplated embodiment, and in conjunction with the accompanying drawings.

DRAWINGS

DETAILED DESCRIPTION OF THE INVENTION

Figure 1:
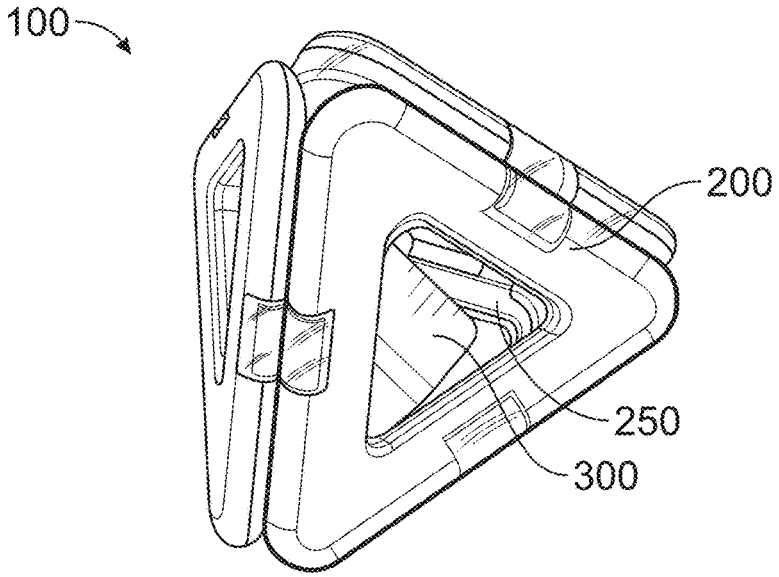
FIG. 1 illustrates a noisemaker according to an embodiment of the invention.

FIG. 1 illustrates a noisemaker 100. Generally, the noisemaker 100 includes a body component 200 comprising a plurality of side portions, and a core component 300. The core component 300 resides within an interior space 250 of the body component 200.

Figure 2:
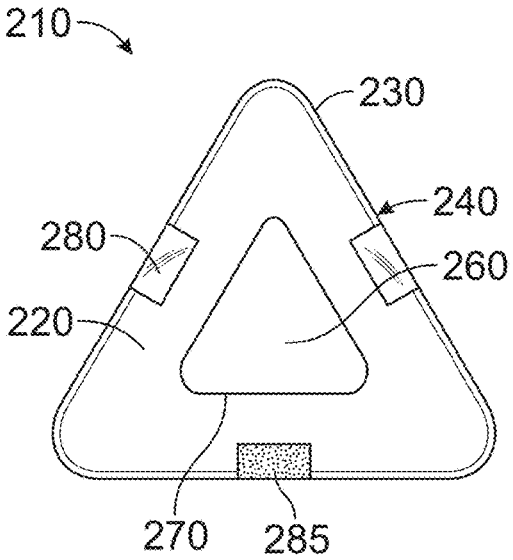
FIG. 2 illustrates an exemplified side portion of the body component.

As shown in FIG. 2, the side portion 210 of the body component 200 comprises an interior face 220 opposing an exterior face 240 with a perimeter edge 230. Side portion 210 may include one or more aperture elements 260. Each aperture element 260 is defined by a boundary surface 270.

Side portions are permanently or impermanently connected to each other through a connection element 280, 285 located along the perimeter edge 230. Side portions that are permanently assembled to each other may include a connection element 280 in the form of adhesive or ultrasonic weld. Side portions that are impermanently assembled to each may include a connection element 285 in the form of a male/female fastener, interlocking components, or magnets. Any known permanent or impermanent connection is contemplated including those resultant from known manufacturing processes.

The side portion 210 is exemplified in FIG. 2 as a triangle. Similarly, the aperture element 260 is exemplified as a triangle. However any geometric form or shape is contemplated for the side portion 210 and aperture element 260. Further, the side portion 210 is illustrated with one aperture element 260 located generally equidistant from the perimeter edge 230. But, any number of aperture elements is contemplated in any arbitrary location. FIG. 6A, FIG. 6B, FIG. 6C, FIG. 6D, FIG. 6E, FIG. 6F, FIG. 6G, FIG. 6H each illustrate an exemplified side portion of the body component according to a contemplated embodiment of the invention.

Figure 3:
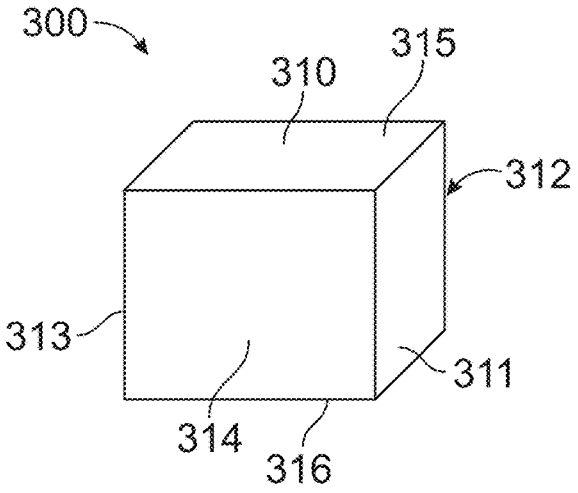
FIG. 3 illustrates an exemplified core component.

FIG. 3 illustrates a three-dimensional core component 300 comprising one or more sides 310. The core component 300 is exemplified in FIG. 3 as a solid cube with sides 311, 312, 313, 314, 315, 316. However, any three-dimension structure is contemplated. FIG. 7A, FIG. 7B, FIG. 7C, FIG. 7D, FIG. 7E, FIG. 7F each illustrate an exemplified core component according to a contemplated embodiment of the invention.

Figure 5A:
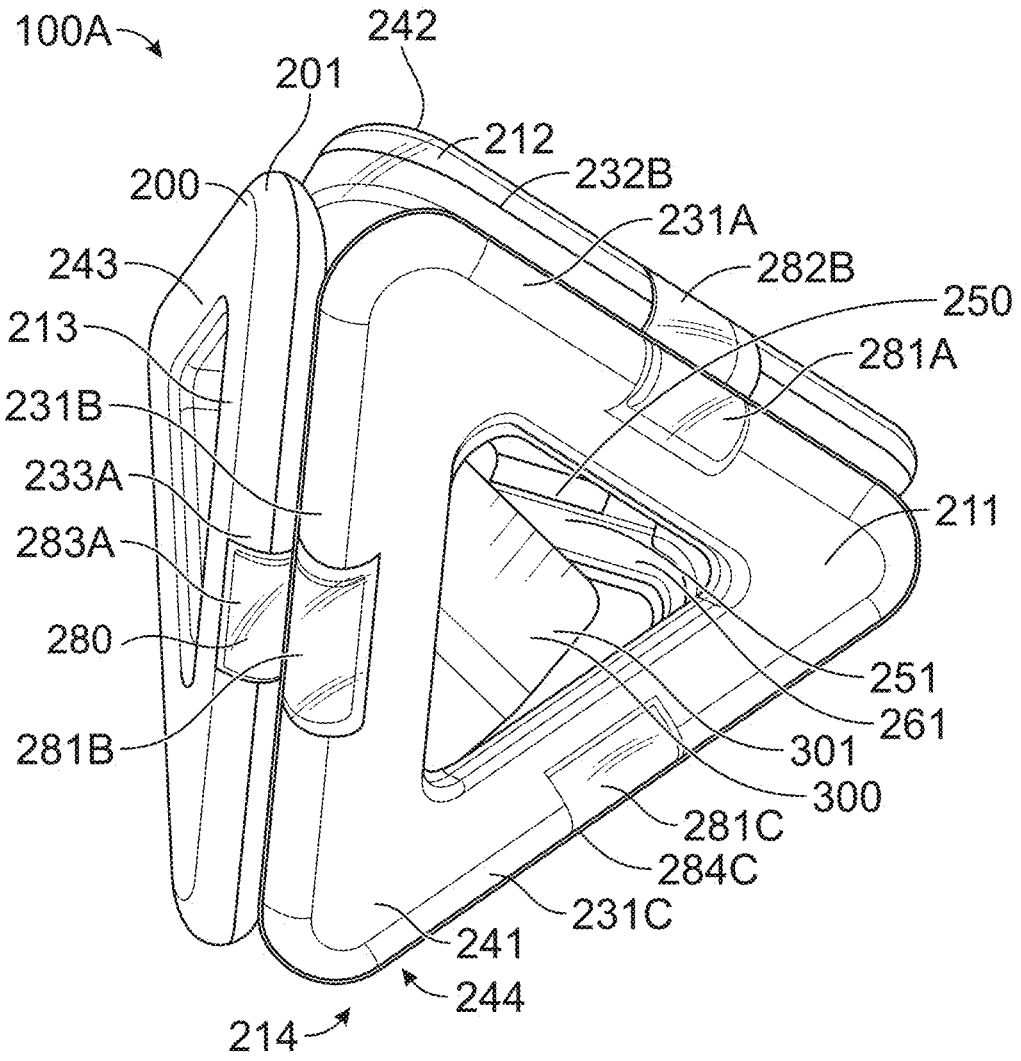
FIG. 5A is an enlarged view of a noisemaker according to one embodiment of the invention.

A particular embodiment of the invention shown in both FIG. 1 and FIG. 5A is now described. In this embodiment, the body component 200 is configured as a hollow tetrahedron 201 and the core component 300 is structured as a solid cube 301.

FIG. 4A, FIG. 4B, FIG. 4C, FIG. 4D each illustrate side portions 211, 212, 213, 214 of the tetrahedron body component 201. Side portion 211 includes an interior face 221 opposing an exterior face 241, and a perimeter edge 231A, 231B, 231C. The side portion 211 includes aperture element 261 defined by boundary surface 271A, 271B, 271C. Each perimeter edge 231A, 231B, 231C may further include a magnet 281A, 281B, 281C permitting side portion 211 to impermanently connect to other side portions 212, 213, 214. Although the side portions are impermanently assembled by magnets, any connection element is contemplated, e.g., male/female fastener, interlocking components, etc.

Figure 4A:
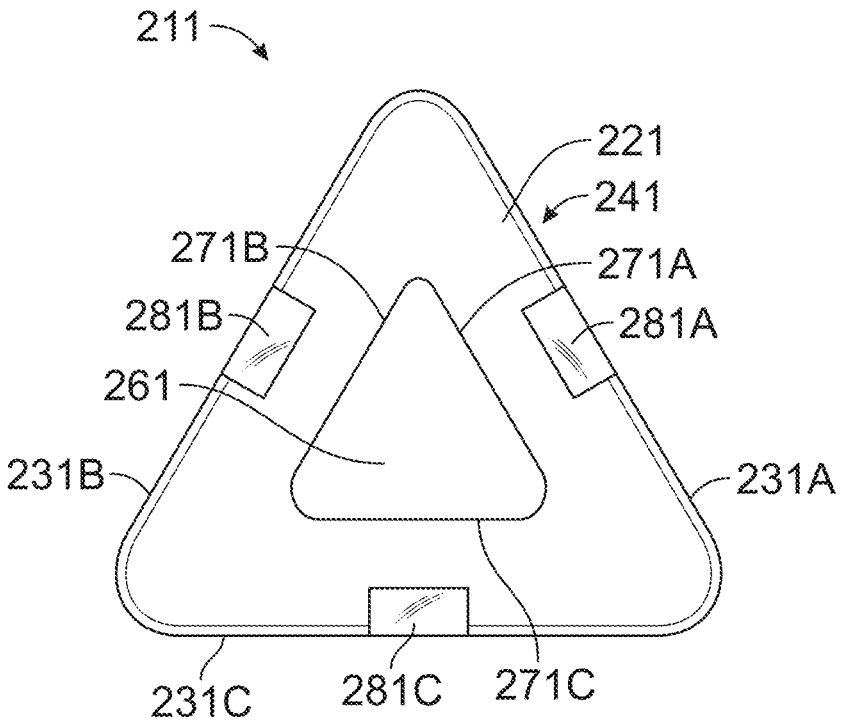
FIG. 4A illustrates a side portion according to an embodiment of the invention.
Figure 4B:
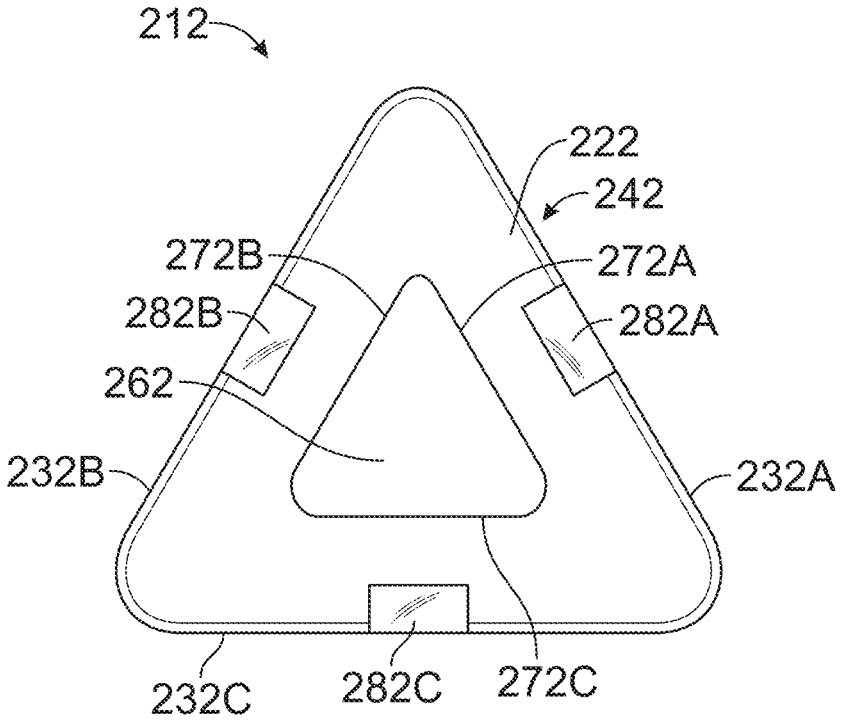
FIG. 4B illustrates a side portion according to an embodiment of the invention.

As shown in FIG. 4B, side portion 212 includes an interior face 222 opposing an exterior face 242, and a perimeter edge 232A, 232B, 232C. The side portion 212 includes aperture element 262 defined by boundary surface 272A, 272B, 272C. Each perimeter edge 232A, 232B, 232C may further include a magnet 282A, 282B, 282C permitting side portion 212 to impermanently connect to other side portions 211, 213, 214.

Figure 4C:
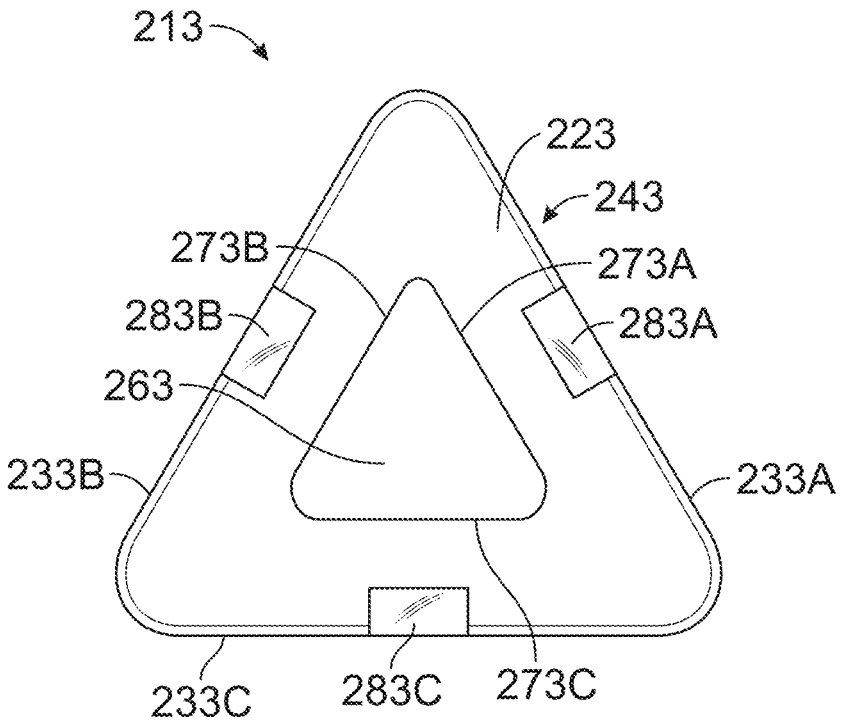
FIG. 4C illustrates a side portion according to an embodiment of the invention.

Side portion 213 is illustrated in FIG. 4C. Side portion 213 includes an interior face 223 opposing an exterior face 243, and a perimeter edge 233A, 233B, 233C. The side portion 213 includes aperture element 263 defined by boundary surface 273A, 273B, 273C. Each edge 233A, 233B, 233C may further include a magnet 283A, 283B, 283C permitting each side portion 213 to impermanently connect to other side portions 211, 212, 214.

Figure 4D:
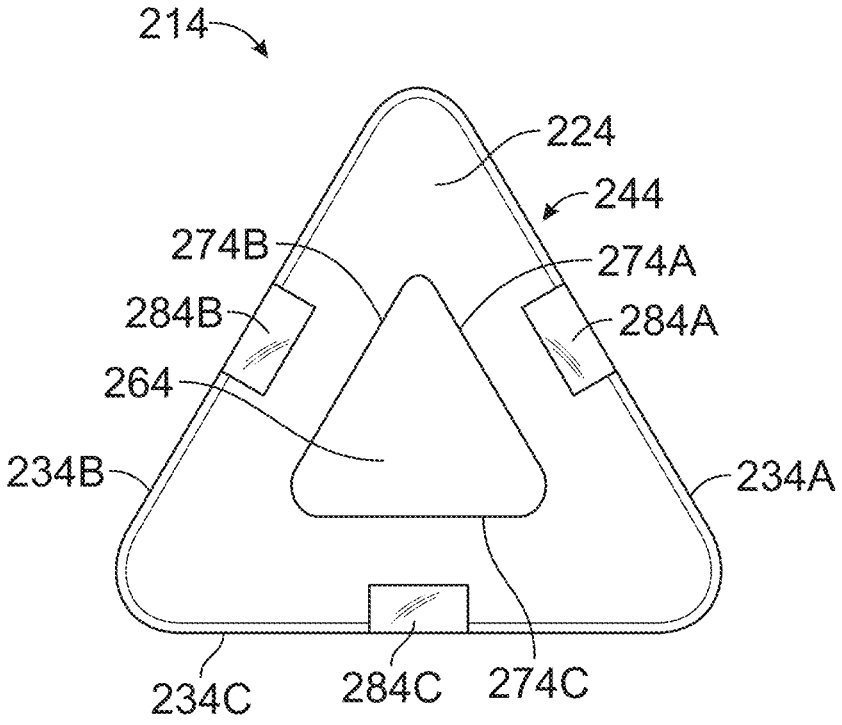
FIG. 4D illustrates a side portion according to an embodiment of the invention.

FIG. 4D illustrates side portion 214. Side portion 214 includes an interior face 224 opposing an exterior face 244, and a perimeter edge 234A, 234B, 234C. The side portion 214 includes aperture element 264 defined by boundary surface 274A, 274B, 274C. Each perimeter edge 234A, 234B, 234C may further include a magnet 284A, 284B, 284C permitting side portion 214 to impermanently connect to other side portions 211, 212, 213.

As shown in FIG. 5A, side portions 211, 212, 213, 214 of noisemaker 100A are assembled together to form body component 200 configured as a hollow tetrahedron 201. In this embodiment, the side portions 211, 212, 213, 214 are impermanently connected through a connection element 280 in the form of magnets. Magnet 281A along perimeter edge 231A of side portion 211 connects to magnet 282B along perimeter edge 232B of side portion 212. Similarly, magnet 281B along perimeter edge 231B of side portion 211 connects to magnet 283A along perimeter edge 233A of side portion 213. And magnet 281C along perimeter edge 231C of side portion 211 connects to magnet 284C of side portion 214. With the side portions 211, 212, 213, 214 assembled, interior faces 221, 222, 223, 224 form an interior space 250. The aperture elements 261, 262, 263, 264 of the side portions each open to interior space 250, here a tetrahedron interior space 251.

Figure 5B:
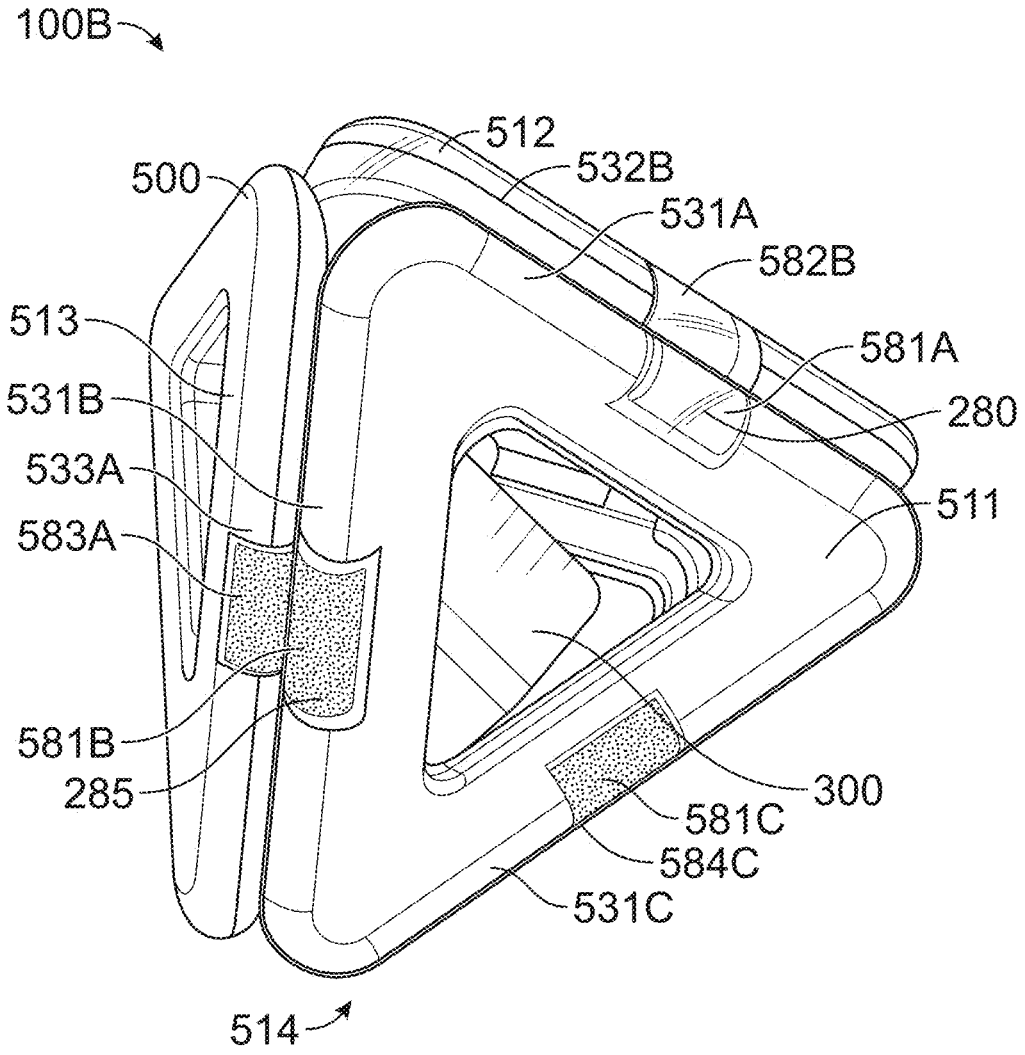
FIG. 5B is an enlarged view of a noisemaker according to another embodiment of the invention.
Figure 6A:
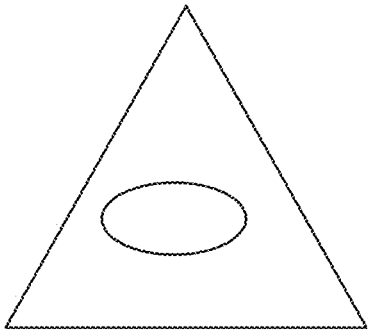
FIG. 6A illustrates an exemplified side portion of the body component according to a contemplated embodiment of the invention.
Figure 6B:
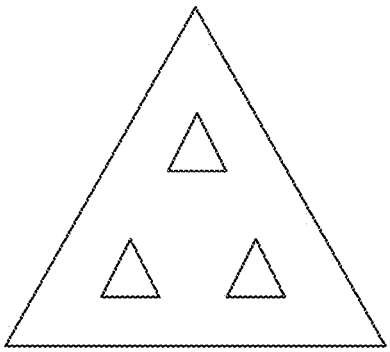
FIG. 6B illustrates an exemplified side portion of the body component according to a contemplated embodiment of the invention.
Figure 6C:
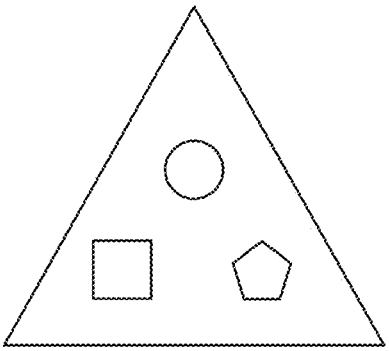
FIG. 6C illustrates an exemplified side portion of the body component according to a contemplated embodiment of the invention.
Figure 6D:
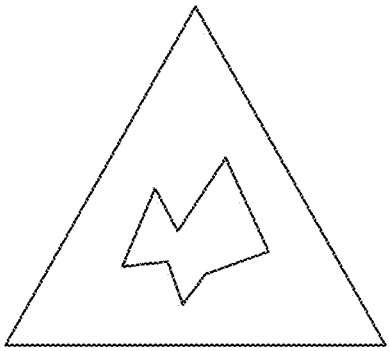
FIG. 6D illustrates an exemplified side portion of the body component according to a contemplated embodiment of the invention.
Figure 6E:
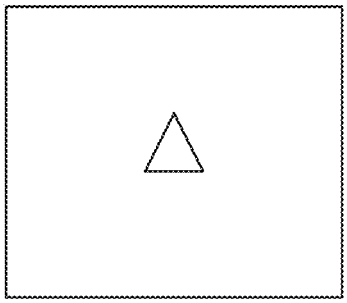
FIG. 6E illustrates an exemplified side portion of the body component according to a contemplated embodiment of the invention.
Figure 6F:
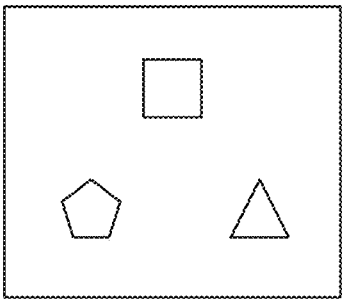
FIG. 6F illustrates an exemplified side portion of the body component according to a contemplated embodiment of the invention.
Figure 6G:
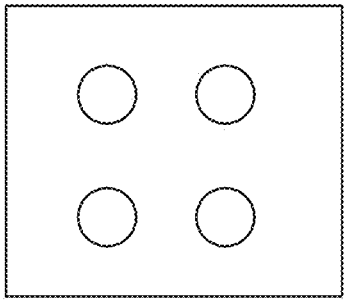
FIG. 6G illustrates an exemplified side portion of the body component according to a contemplated embodiment of the invention.
Figure 6H:
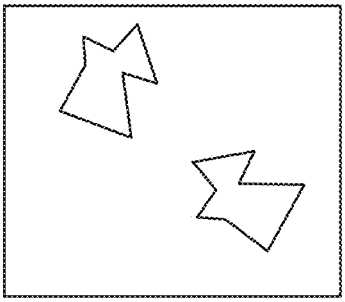
FIG. 6H illustrates an exemplified side portion of the body component according to a contemplated embodiment of the invention.
Figure 7A:
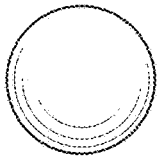
FIG. 7A illustrates an exemplified core component according to a contemplated embodiment of the invention.
Figure 7B:
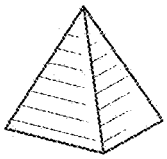
FIG. 7B illustrates an exemplified core component according to a contemplated embodiment of the invention.
Figure 7C:
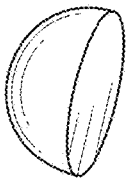
FIG. 7C illustrates an exemplified core component according to a contemplated embodiment of the invention.
Figure 7D:
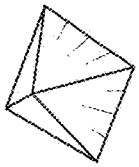
FIG. 7D illustrates an exemplified core component according to a contemplated embodiment of the invention.
Figure 7E:
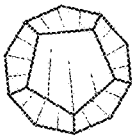
FIG. 7E illustrates an exemplified core component according to a contemplated embodiment of the invention.
Figure 7F:
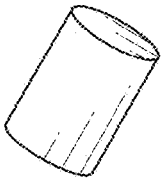
FIG. 7F illustrates an exemplified core component according to a contemplated embodiment of the invention.

Another embodiment of the invention shown in FIG. 5B is now described. In this embodiment, the body component 500 is configured with side portions that are permanently connected to each other.

As shown in FIG. 5B, side portions 511, 512, 513, 514 of noisemaker 100B are assembled together to form body component 500. In this embodiment, side portion 512 is impermanently connected through a connection element 280 to side portions 511, 513, 514. And side portions 511, 513, 514 are permanently connected together through a connection element 285.

Side portion 512 may be impermanently connected to side portions 511, 513, 514 using magnets as described above; Magnet 581A along perimeter edge 531A of side portion 511 connects to magnet 582B along perimeter edge 532B of side portion 512. Although the side portions are impermanently assembled by magnets, any impermanent connection element is contemplated, e.g., male/female fastener, interlocking components, etc.

Figure 8A:
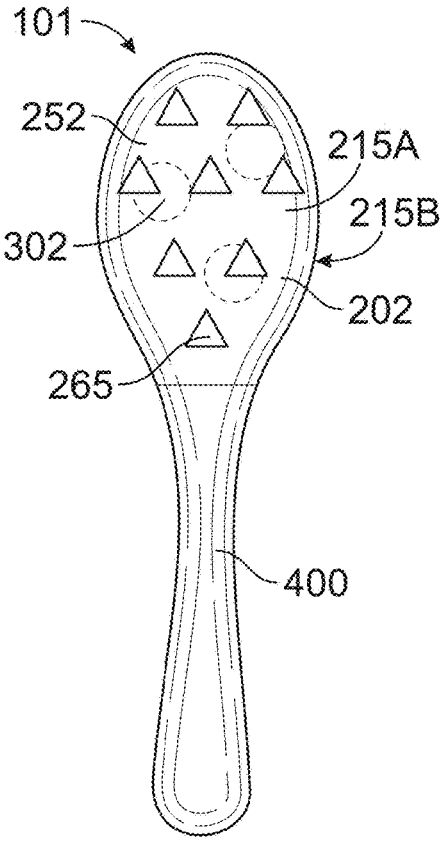
FIG. 8A illustrates a noisemaker according to a contemplated embodiment of the invention.
Figure 8B:
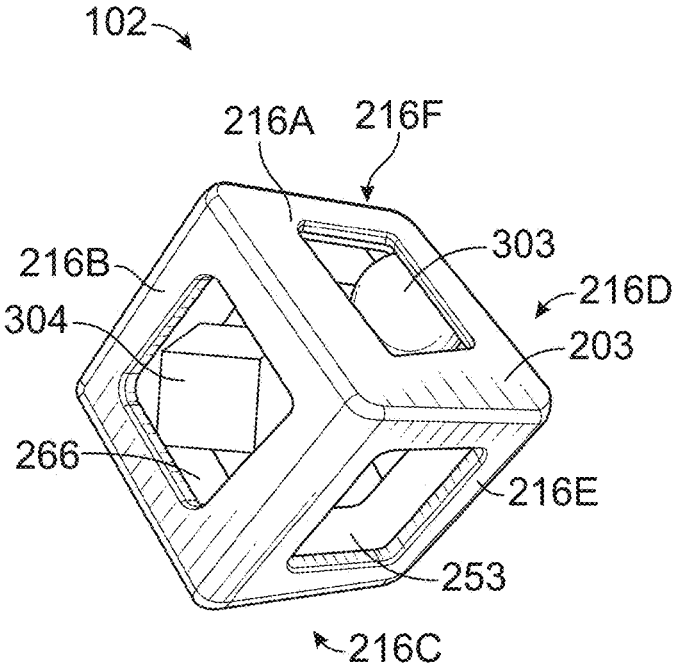
FIG. 8B illustrates a noisemaker according to a contemplated embodiment of the invention.

Side portions 511, 513, 514 may be permanently connected together through a connection element 285 in the form of an adhesive. As shown, adhesive 581B along perimeter edge 531B of side portion 511 connects to adhesive 583A along perimeter edge 533A of side portion 513. And adhesive 581C along perimeter edge 531C of side portion 511 connects to adhesive 584C of side portion 514. Although the side portions are permanently assembled by adhesive, any permanent connection element is contemplated, e.g., ultrasonic weld etc. As shown in FIG. 5A and FIG. 5B, one core component 300 resides within interior space 250 of the body component 200. However, any number of core components 300 is contemplated. FIG. 8A and FIG. 8B each illustrate a noisemaker with two or more core components. Here, the core component 300 is configured as a solid cube shape 301.

According to a specific embodiment of the invention shown in FIG. 5A and FIG. 5B, the solid cube shape core component has sides measuring 15 millimeters in size, and each perimeter edge of the triangle side portion measure 65 millimeters with each boundary surface of the aperture element measuring 20 millimeters in size. But, any size for the body component including size of the interior space, size of each aperture element, and size of each core component is contemplated provided that the one or more core components remains within the interior space of the body component, and specifically while the noisemaker is played.

The noisemaker is played by being struck, scraped, or rubbed while holding it directly via the body component. It is also contemplated that the noisemaker may be played by moving it indirectly through a handle component. FIG. 8A illustrates a noisemaker including handle component 400. It is contemplated that handle component 400 may be permanently or impermanently connected to body component.

Each core component moves freely within the interior space and sound is produced by vibration from striking the interior surfaces of the body component and/or aperture elements. Vibration may also be resultant from the core component striking the boundary surface of the aperture element.

Numerous embodiments of the invention are contemplated. In one embodiment, the noisemaker comprises a body component with only one side portion having one aperture element. Of course, different notes or sounds can be produced by a body component comprising two or more side portions each with one or more aperture elements. Furthermore, embodiments of the invention may consist of one core component while other embodiments comprise two or more core components, each providing different notes or sounds.

As mentioned above, new and unique notes or sounds are produced by the noisemaker. The new and unique notes or sounds produced depend upon a combination of: (1) size of the body component including size of the interior space, (2) shape of the body component including shape of the interior space, (3) material of the body component, (4) size of each aperture element, (5) shape of each aperture element, (6) number of aperture elements, (7) size of each core component, (8) shape of each core component, (9) material of each core component, and (10) number of core components. The plethora of combinations possible from (1) through (10) provide the noisemaker with a vast variety of notes or sounds that can be produced.

As shown in FIG. 8A, an embodiment of a noisemaker 101 comprises hollow ovoid shape body component 202 connected to handle component 400. Body component comprises two hollow hemisphere side portions 215A, 215B assembled together to form an ovoid interior space 252. Each side portion 215A, 215B includes a plurality of triangular shaped aperture elements 265. Three spherical core components 302 freely move with the ovoid interior space 252 of the ovoid body component 202.

As shown in FIG. 8B, an embodiment of a noisemaker 102 comprises hollow cuboid shape body component 203. The body component 203 comprises square side portions 216A, 216B, 216C, 216D, 216E, 216F, assembled together to form a cuboid interior space 253. Each side portion 216A, 216B, 216C, 216D, 216E, 216F includes one square shaped aperture element 266. One spherical core component 303 and one cube core component 304 freely move with the interior space 253 of the body component 203.

The described embodiments are to be considered in all respects only as illustrative and not restrictive, and the scope of the invention is not limited to this description. Those of skill in the art may recognize changes, substitutions, adaptations and other modifications that may nonetheless come within the scope of the invention.

The invention claimed is:

1. A noisemaker comprising:

a body component comprising a plurality of side portions, wherein two or more side portions are assembled permanently together and one or more side portions are assembled impermanently to the two or more permanently assembled side portions to form a three-dimensional configuration with an interior space, one or more side portions of the plurality comprising one or more aperture elements that open to the interior space, one or more interchangeable core component within the interior space of the body component, the one or more interchangeable core component configured to move freely within the body component while not escaping through each aperture element, the body component and the one or more interchangeable core component constructed from any material combination, wherein the material combination is configured to produce musical sounds when the noisemaker is played.

2. The noisemaker according to claim 1, wherein each side portion is a geometric form selected from the group consisting of: a square, a triangle, a rectangle, a pentagon, a hexagon, an octagon, a parallelogram, a hollow hemisphere.

3. The noisemaker according to claim 1, wherein each aperture element is a shape selected from the group consisting of: a triangle, a rectangle, a pentagon, a hexagon, an octagon, a parallelogram.

4. The noisemaker according to claim 1, wherein the one or more interchangeable core component is a solid three-dimensional structure.

5. The noisemaker according to claim 1, wherein the one or more interchange able core component is a three-dimensional structure selected from the group consisting of: a polyhedron a pyramid, a cylinder, a cone, a prism, a sphere.

6. The noisemaker according to claim 1, wherein the body component and the one or more interchangeable core component are both made from the same material.

7. The noisemaker according to claim 1, wherein the body component is made from a metal material and the one or more interchangeable core component is made from a wood material.

8. The noisemaker according to claim 1, wherein the body component is constructed from one or more materials selected from the group consisting of: wood, metal, alloy, canvas, plastic, glass, felts, rubber, animal skin.

9. The noisemaker according to claim 1, wherein the one or more interchangeable core component is constructed from one or more materials selected from the group consisting of: wood, metal, alloy, canvas, plastic, glass, felts, rubber, animal skin.

10. The noisemaker according to claim 1 further comprising a handle component.

11. A noisemaker comprising:

a body component comprising four triangle side portions, each triangle side portion assembled together to form a three-dimensional tetrahedron configuration with an interior space, wherein one triangle side portion is connected impermanently to the other three triangle side portions, the other three triangle side portions connected permanently to each other, one or more of the four triangle side portions comprising one or more triangle aperture elements that open to the interior space, a solid cube interchangeable core component within the interior space of the body component, the solid cube core component configured to move freely within the body component while not escaping through each triangle aperture element, the body component and the solid cube core component constructed from any material combination, wherein the material combination is configured to produce musical sounds when the noisemaker is played.

12. The noisemaker according to claim 11, wherein the body component and the solid cube core component are both made from the same material.

13. The noisemaker according to claim 11, wherein the body component is made from a wood material and the core component is made from a metal material.

14. The noisemaker according to claim 11, wherein a perimeter edge of each triangle side portion comprises a connection element configured to connect to the connection element of another side portion.

15. The noisemaker according to claim 11, wherein the one triangle side portion connected impermanently is partially detachable or completely detachable from the other three triangle side portions.

16. The noisemaker according to claim 11 further comprising a handle component.

17. A noisemaker comprising:

a body component comprising side portions, each side portion assembled together to form a three-dimensional configuration with an interior space, wherein at least one side portion is connected impermanently to the other side portions, and the other side portions are connected permanently to each other, one or more of the side portions comprising one or more aperture elements that open to the interior space, one or more interchangeable core component within the interior space of the body component, the one or more interchangeable core component configured to move freely within the body component while not escaping through each aperture element, the body component and the one or more interchangeable core component constructed from wood, wherein the material combination is configured to produce musical sounds when the noisemaker is played.

18. The noisemaker according to claim 17, wherein the at least one side portion is partially detachable or completely detachable from the other side portions.

19. The noisemaker according to claim 17 further comprising a handle component.

* * * * *